US006036006A

United States Patent [19]

Focke

[11] Patent Number: 6,036,006

[45] Date of Patent: Mar. 14, 2000

[54] CIGARETTE PACK WITH PRINTED CARRIER AND METHOD OF MANUFACTURING

[75] Inventor: Heinz Focke, Verden, Germany

[73] Assignee: Focke & Co. (GmbH & Co.), Verden, Germany

[21] Appl. No.: 08/884,970

[22] Filed: Jun. 30, 1997

Related U.S. Application Data

[63] Continuation-in-part of application No. 08/546,472, Oct. 20, 1995, abandoned.

[30] Foreign Application Priority Data

Oct. 25, 1994 [DE] Germany ..... 44 37 782

[51] Int. Cl.[7] ..... A24F 15/00

[52] U.S. Cl. ..... 206/264; 206/271; 206/831

[58] Field of Search ..... 206/232, 242, 206/264, 271, 273, 275, 459.5, 831; 229/70

[56] References Cited

U.S. PATENT DOCUMENTS

| | | | |
|---|---|---|---|
| 1,452,692 | 4/1923 | Lazaga . | |
| 2,321,112 | 6/1943 | Tamarin | 206/4.2 |
| 3,062,430 | 11/1962 | Rutledge | 229/37 |
| 3,087,605 | 4/1963 | Kester | 205/45.33 |
| 3,132,028 | 5/1964 | Austin et al. | 99/171 |
| 3,251,152 | 5/1966 | Takefman | 40/312 |
| 3,311,281 | 3/1967 | Eisman | 229/16 |
| 3,695,422 | 10/1972 | Tripodi | 206/831 |
| 4,103,820 | 8/1978 | Mathison et al. | 229/37 R |
| 4,778,962 | 10/1988 | Shimada | 206/254 |
| 4,836,378 | 6/1989 | Lephardt | 206/459 |
| 5,137,148 | 8/1992 | Evers | 206/273 |
| 5,146,729 | 9/1992 | Sata | 53/445 |
| 5,178,272 | 1/1993 | Evers | 206/264 |
| 5,375,704 | 12/1994 | Focke et al. | 206/268 |

FOREIGN PATENT DOCUMENTS

| | | |
|---|---|---|
| 0596225 | 8/1993 | European Pat. Off. . |
| 7630671 | 9/1976 | Germany . |
| 3634489 A1 | 10/1986 | Germany . |
| 4237523 A1 | 11/1992 | Germany . |

*Primary Examiner*—David T. Fidei
*Attorney, Agent, or Firm*—Abelman, Frayne & Schwab

[57] ABSTRACT

A cuboidal pack for cigarettes, such as a soft pack or a box with a hinged lid, is provided with a separate printed carrier, or coupon-like insert, that is used for advertising purposes or conducting drawings, contests and the like. The separate printed carrier is inserted between adjacent layers of the wrappers forming the pack and is of a size that is adapted to be folded to cover one end wall and a portion of the front and/or back walls, while not covering the usually visible surfaces of the front and/or back walls of the pack to an excessive extent. When the outer wrapper is opened, the separate printed carrier can be removed, as by pulling on a tongue-shaped gripping piece that is folded across the top of the pack.

18 Claims, 5 Drawing Sheets

CIGARETTE PACK WITH PRINTED CARRIER AND METHOD OF MANUFACTURING

This application is a continuation-in-part of application Ser. No. 08/546,472 filed Oct. 20, 1995, now abandoned.

BACKGROUND OF THE INVENTION

1. Field of the Invention

The invention relates to a cuboidal pack for cigarettes or the like, having a front wall, rear wall, narrow side walls and a base wall and end wall, the pack being enclosed by an outer wrapper consisting of transparent material, such as cellophane or polymer film, and a printing carrier or coupon comprising a separate blank being added to the pack.

2. Description of the Prior Art

Packs so known as "soft packs" for cigarettes are designed predominantly as soft-carton packs or as hinge-lid boxes (hinge-lid pack). The construction of a pack of this type is such that the pack contents, namely a cigarette group, are enclosed fully by an inner blank consisting of paper or thin foil. The cigarette block formed in this manner is positioned in the hinge-lid box consisting of thin cardboard or in a paper carton or wrapper which is open at the top. An outer wrapper usually consists of cellophane or polymer film. For opening the pack, the outer wrapper, which is closed on all sides, is provided with a tear-open strip, which usually runs beneath the end wall and permits severing of an upper cap of the outer wrapper.

For many reasons, coupons or printing carriers formed from a separate blank are frequently added to such packs. These coupons or printing carriers serve for advertising purposes, but are also used for taking part in competitions, drawings, etc. The printing carrier is usually provided on the packs in the region of the front wall or rear wall of said packs.

The object of the invention is to improve said packs in terms of the configuration and arrangement of the printing carriers (coupons).

SUMMARY OF THE INVENTION

In order to achieve this object, the pack according to the invention in defined in that the printing carrier, folded in angular form, extends, with a (transverse) leg, in the region of one of the side walls and, with at least one other leg, in the region of the front wall or rear wall. In each case, the printing carrier according to the invention is designed and arranged such that it does not extend into the region of the base wall of the pack. Furthermore, the printing carrier is configured such that it extends around at least one of the upright pack edges by virtue of right-angled folding.

By virtue of the abovementioned design and arrangement of the printing carrier, it is possible to design the latter to be larger. Furthermore, the printing carrier may be configured such that the assigned transverse leg extends over the entire width of the side wall, but the other leg extends only over a small region of the front wall or rear wall. Despite the presence of a comparatively large-surface-area printing carrier, the outer side of said front wall and rear wall can thus be detected by the consumer partially or virtually wholly.

The arrangement according to the invention of the printing carrier also has advantages in the production of the pack and attachment of the printing carrier. The latter can be brought into the folded position together with the outer wrapper. By folding over the printing carrier together with the outer wrapper, the printing carrier is better fixed in the desired position on the pack.

According to a further proposal, the printing carrier is provided with a gripping piece or a gripping lug, which rests against the end wall when the pack is in the closed state. After severing an upper part of the outer wrapper, the gripping piece in exposed. The printing carrier can then be drawn out of the pack with the aid of the gripping piece, to be precise out of the region between the outer wrapper of the hinge-lid box or, in the case of a corresponding arrangement, between the inner wrapper and the soft carton.

BRIEF DESCRIPTION OF THE DRAWINGS

Exemplary embodiments of the invention are explained in more detail hereinbelow with reference to the drawings, in which.

DESCRIPTION OF THE PREFERRED EMBODIMENTS

Figure 1:
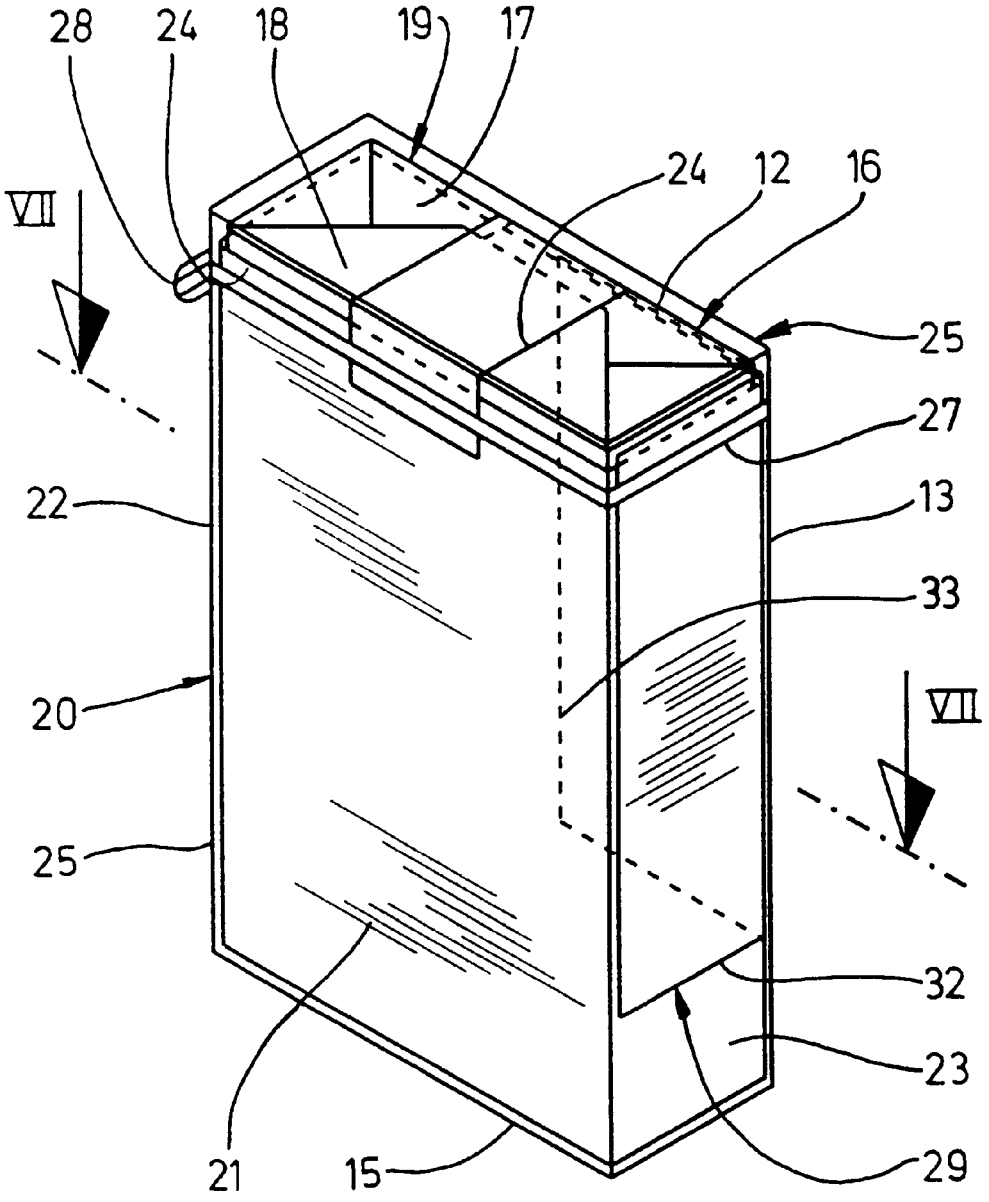
FIG. 1 shown a perspective representation of a soft-carton pack with coupon.

The exemplary embodiments, represented in the drawings, of packs of cigarettes 10 are designed as soft-carton packs. The basic construction of a pack of this type is such that a cigarette group 11 is fully enclosed by an inner wrapper 12. The latter usually comprises a single-part blank consisting of paper or tin foil. In the present examples, the inner wrapper 12 is laid around the cigarette group 11 such that an overlap 14 is formed in the region of a rear wall 13. In the region of the base wall 15, the inner wrapper 12 is provided with a fold, just as in the region of an and wall 16. Said end wall 16 exhibits trapezoidal end tabs 17 and 18 which are folded in the manner of an envelope and partially cover over one another. The cigarette group 11 forms, with the inner wrapper 12, a unit, namely a cigarette block 19.

The cigarette block 19 constitutes the contents of the pack. Here, the latter comprises a soft carton 20 consisting of paper or a similar, foldable packaging material. The soft carton 20 is likewise formed from a rectangular, single-part blank, such that a large-surface-area front wall 21 and, opposite this, the correspondingly designed rear wall 13 are produced. Upright narrow side walls 22 and 23 connect the front wall 21 and rear wall 13. A base wall is formed by folding the blank for the soft carton 20. The soft carton 20 is open at the top in the region of the end wall 16. Said carton terminates with a peripheral carton border at a (small) distance beneath the end wall 16.

The blank of the soft carton 20 or soft cup respectively is being folded around the cigarette group 11 or cigarette block 19 starting at one of the side walls 22, namely at the side wall 23. Side flaps of the blank for soft carton 20 being folded at the opposite side wall 22 forming an overlap 40 of these side flaps. Additionally the blank is being folded in the area of the base wall 15. As used herein the term "partially completed pack (20') is used to describe the article at this stage of the manufacture of the pack.

The end wall 16 is retained in the closed position by a strip 24 which extends in a U-shaped Planner from the front wall 21, via the end wall 16, to the rear wall 13. The strip 24 is usually a revenue stamp.

The pack designed in this manner is enclosed on all sides by an outer wrapper 25. The latter consists of transparent material, namely cellophane or plastic film. A single-part blank for said outer wrapper 25 is folded such that an overlap 26 in formed in the region of the side wall 22. Base wall and and wall are folded analogously to the inner wrapper 12.

In order to open the pack, first of all the outer wrapper 25 has to be opened or removed. The outer wrapper 25 is provided with a tear-open aid, namely with a peripheral tear-open strip 27. The latter extends at a (small) distance beneath the end wall 16. By means of a grip end 28, the tear-open strip 27 can be grasped and drawn off, the outer wrapper 25 being severed in the process. A cap-like upper part of the outer wrapper 25 is consequently severed, with the result that the upper region of the pack is exposed. The pack can then be opened by tearing open the inner wrapper 12 in the region of the end wall 16.

The pack in assigned a printing carrier 29, 30, 31 in each case. Said printing carrier is a blank which, in the present case, is rectangular and has printing at least on the outwardly directed side. Said printing may be information, advertisements or details of a competition, of a draw, etc. The printing carrier 29, 30, 31 may be differently designed and be positioned in or on the pack.

Figure 7:
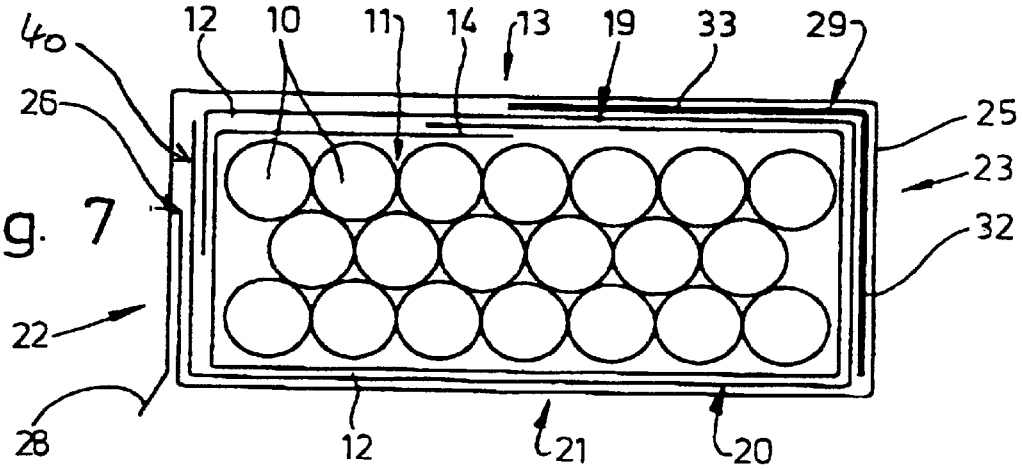
FIG. 7 shows a representation corresponding to the exemplary embodiment of FIG. 1.

In the case of the exemplary embodiment according to FIGS. 1 and 7, the printing carrier 29 is arranged between the outer wrapper 25 and the soft carton 20. The printing carrier 29 is configured to be angular in horizontal section. A first leg 32 extends in the region of a side wall 23, to be precise over the entire width thereof. Another leg 33 in located at right angles thereto, in the region of the rear wall 13 (or front wall 21). The leg 33 is designed with considerably smaller widths than the rear wall 13; in the depicted exemplary embodiment according to FIG. 7, the width of the leg 33 is approximately half the width of the rear wall 13. Consequently, a considerable part of the latter is also clearly visible to the viewer before the printing carrier 29 is removed.

The relative position of the printing carrier 29 is such that, at the top, it extends directly up to the end wall 16 and, at the bottom, maintains a relatively large distance from the base wall 15. When the pack in opened, namely after the upper part of the outer wrapper 25 is severed by the tear-open strip 27, an upper end of the printing carrier 29 in exposed, and it can thus be grasped by hand and drawn out of the pack.

Figure 2:
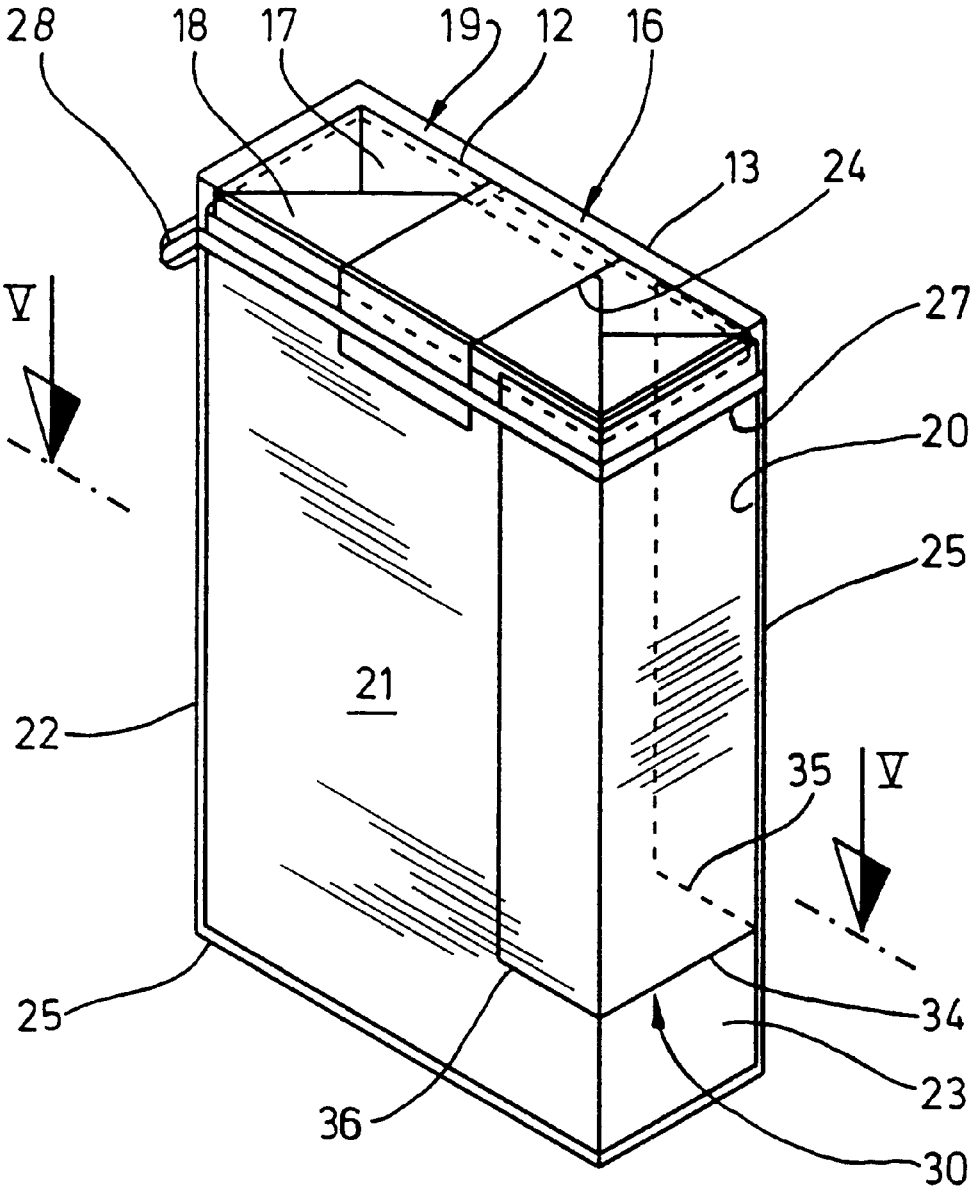
FIG. 2 shows, likewise in perspective representation, a soft-carton pack with a coupon arranged in a different manner.
Figure 5:
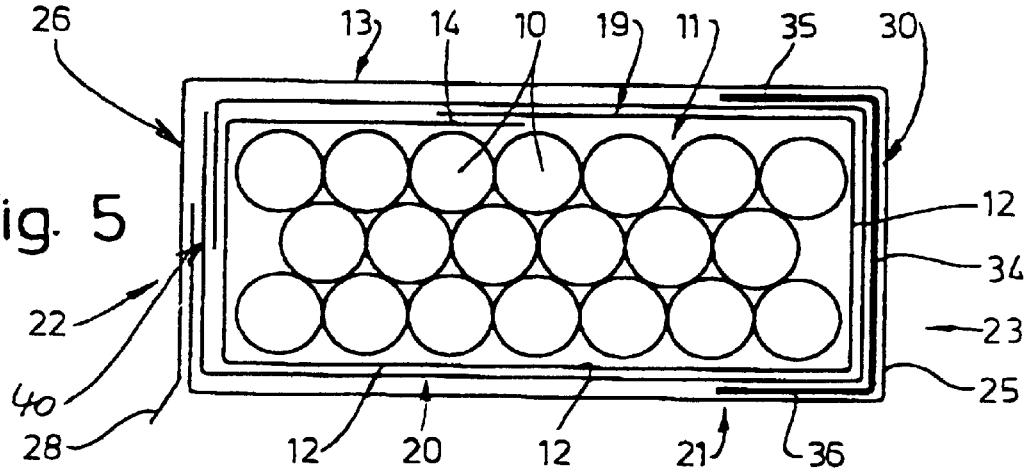
FIG. 5 shows, on an enlarged scale, a horizontal section of the pack according to FIG. 2.

In the case of the exemplary embodiment according to FIGS. 2 and 5, the printing carrier 30 is positioned such that the transverse leg 34 extends in the region of the side wall 23 and two legs 35, 36 of the same width extend, adjoining the transverse leg 34, in the region of the rear wall 13 and the front wall 21. The legs 35 and 36 are designed to be of a considerably smaller width than the rear wall 13 and front wall 21, that is to say only as a border strip. Most of the area of the abovementioned pack walls is thus clearly visible. This printing carrier 30 too is positioned between the outer wrapper and the pack, such that an upper and can be grasped and drawn out after an upper part of the outer wrapper 25 has been removed.

Figure 3:
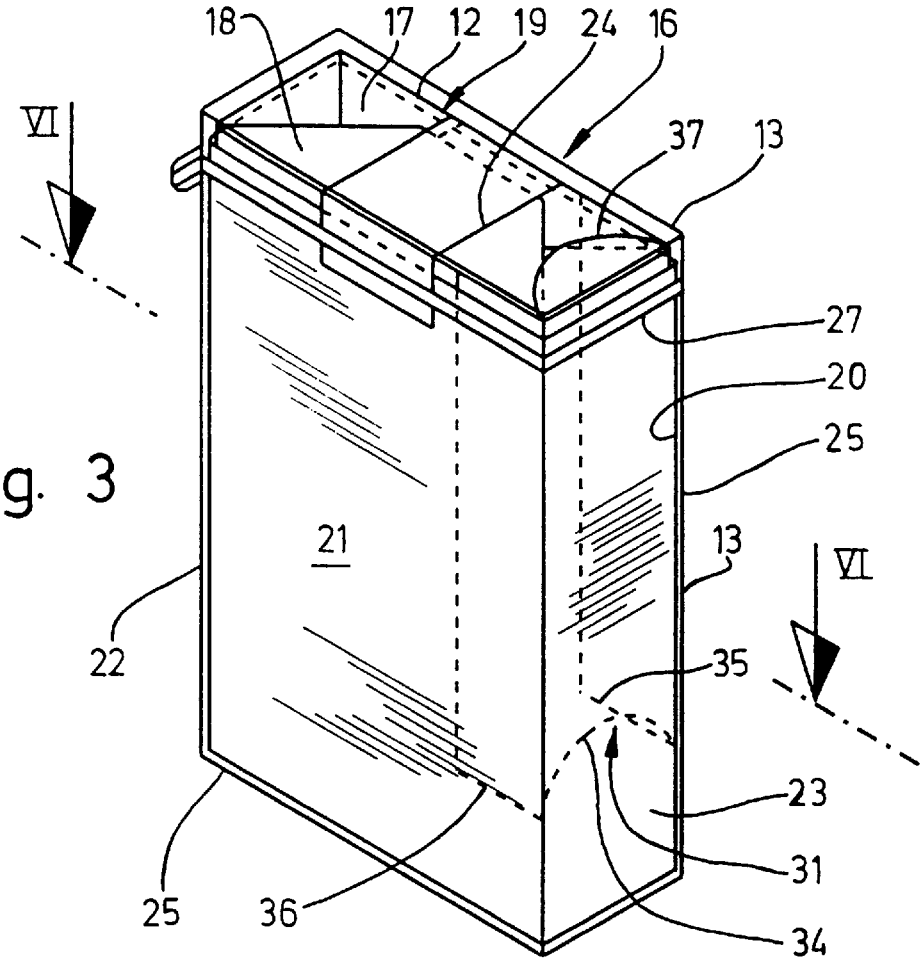
FIG. 3 shows, likewise in perspective representation, a soft-carton pack with a third configuration of a coupon
Figure 6:
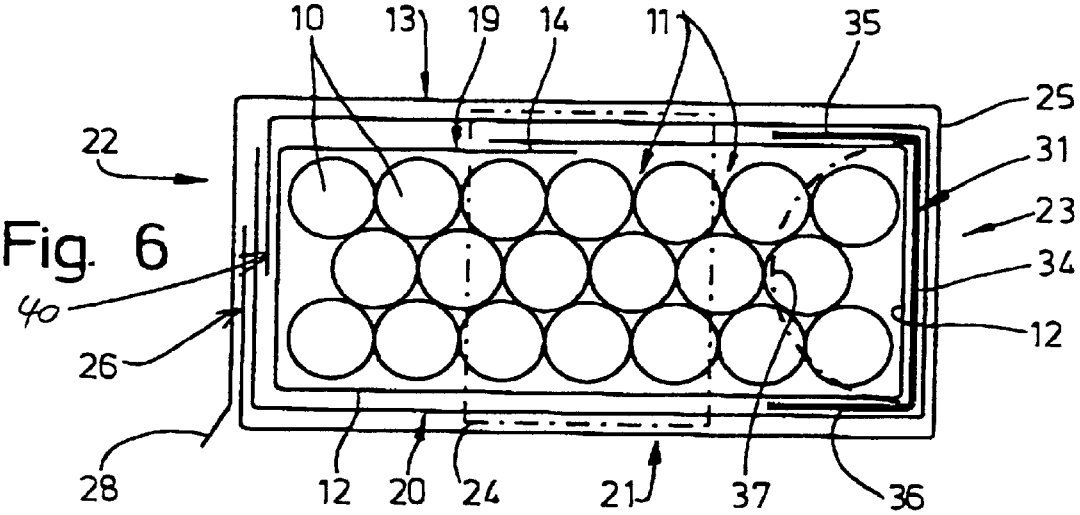
FIG. 6 shows, likewise in an enlarged horizontal section, the pack according to FIG. 3.

In the case of the embodiment of the printing carrier 31 according to FIGS. 3 and 6, a separate gripping piece 37 is provided on the printing carrier 31 in order to grasp the printing carrier 31 and draw it out of the pack. In the case of this configuration, the printing carrier 31 may be positioned—as in the case of the abovedescribed exemplary embodiments—between the pack itself, namely the soft carton 20, and the outer wrapper 25. It is, however, also possible to arrange the printing carrier 31 within the pack, that is to say within the soft carton 20, to be precise between the soft carton 20 and the inner wrapper 12. As can be seen from FIG. 3, the printing carrier 31 is arranged in the pack such that the gripping piece 37 projects out of the soft carton 20 at the top. The tongue-like gripping piece 37, which is of a circular contour in the present case, is folded over into the plane of the end wall 16 before the pack is opened. In this arrangement, the gripping piece 37 is covered by the outer wrapper 25 before the latter is opened.

Figure 4:
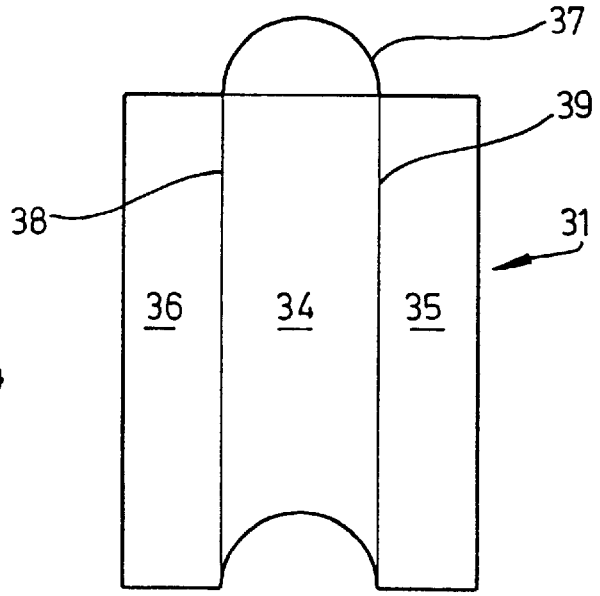
FIG. 4 shows the coupon of FIG. 3 as a spread-out blank.

The printing carrier 29 . . . 31 can be manufactured from a continuous material web by severing. This also applies to the exemplary embodiment according to FIG. 3 and FIG. 4. As can be seen, the tongue-like gripping piece 37 is punched out of the transverse leg 34 of a following printing carrier 31 within the material web. Otherwise, the printing carrier 31 corresponds, in terms of configuration and arrangement, to the printing carrier 30 of FIG. 2.

For producing the packs and attaching the printing carrier 29 . . . 31, the procedure is expediently such that the respective printing carrier 29, 30, 31 is in each case held ready in the correct position with a blank for the outer wrapper 25—or for the soft carton 20—in a plane transverse to the conveying direction of the pack and/or of the pack contents. The pack contents are then pushed through a mouthpiece, in the manner known in principle with the blank being carried along in the process, the blank being laid around the pack or around the pack contents in the form of a U. In the present case, the printing carrier 29, 30, 31 is folded together with the blank and held in position by virtue of the angled configuration. For this purpose, the printing carrier 29, 30, 31, which may, if appropriate, consist of thin cardboard, may already be provided with prestanped folding lines 38, 39.

All the configurations of the printing carriers 29, 30, 31 may also be used in the case of a hinge-lid box of conventional construction. The geometrical configuration of the printing carrier is always such that none of its regions extend in the plane of the base wall 15. Rather, the printing carrier 29, 30, 31 is always folded around one or two upright pack edges.

Figure 8:
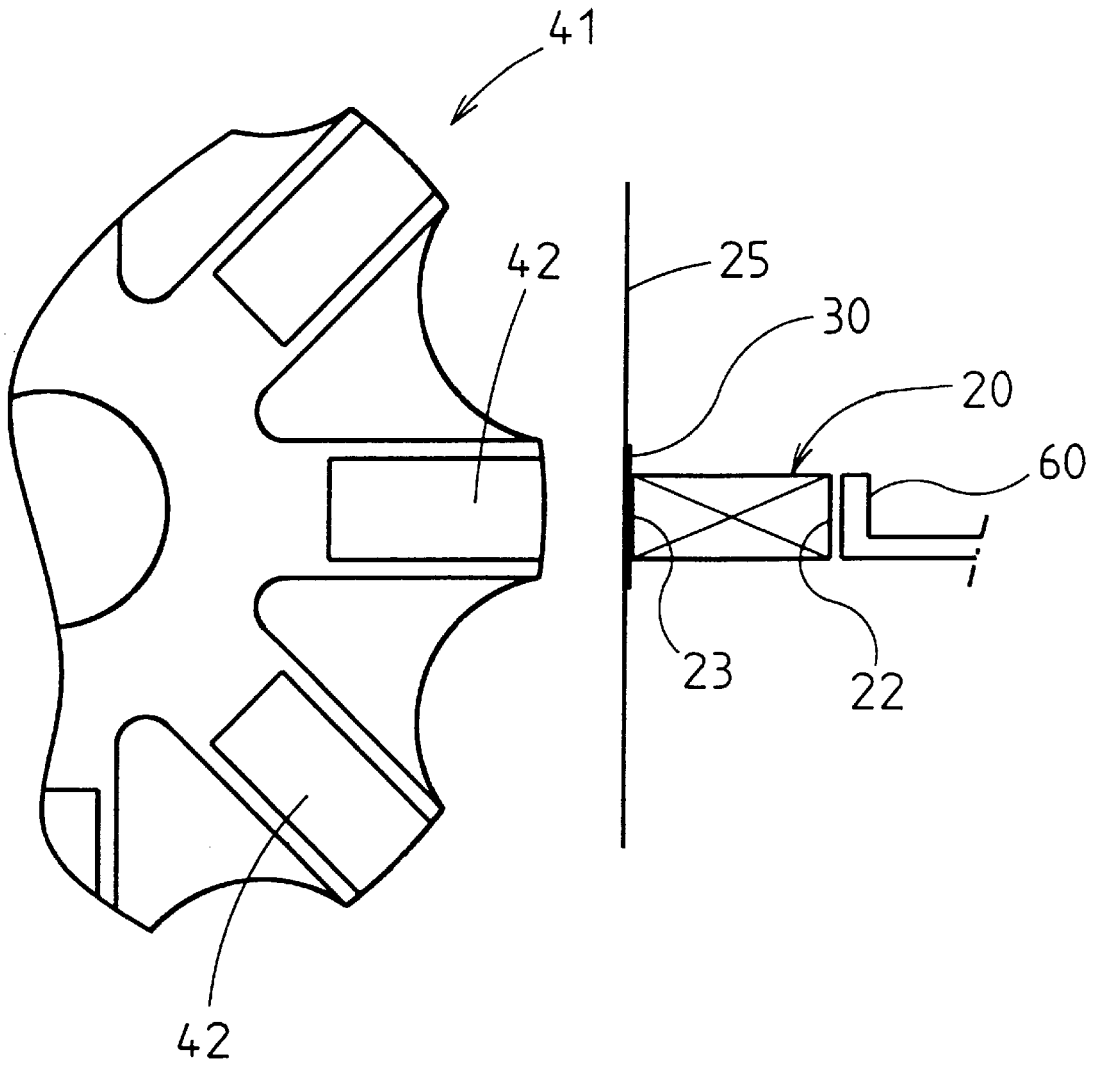
FIG. 8 is a schematic plan view of a portion of a rotating turret of a cigarette manufacturing machine and a partially completed pack.

The method or steps of producing a pack with a printing carrier 29, 30, 31 in accordance with the invention are schematically illustrated in FIG. 8. The several blanks comprising the pack are folded in sequence by one or more folding turrets 41. Folding turret 41 has a plurality of cavities 42 arranged about the periphery of the folding turret 41, each cavity having an open side for receiving the pack or the cigarette block 19 in the cavity 42, together with a blank, e.g., 25, to be folded around the pack.

FIG. 8 illustrates the step-wise process and equipment for positioning a printing carrier 30 or 31 as shown in FIG. 5 and FIG. 6. For example, the blank shown in FIG. 8 in a vertical position is the blank for the outer wrapper 25. This blank is folded around the pack 22 consisting of the cigarette block 19 and the soft carton 20. The outer wrapper blank 25 is positioned at the side wall 23 with the printing carrier 30 between the outer wrapper 25 and the side wall 23 of the pack 19, 20.

With continued reference to FIG. 8, cigarette block 19, inner wrapper outer wrapper 25 and printing carrier 30 are pushed by reciprocating arm 60 into a cavity 42 of the folding turret 41. By this movement, the blank 25 and the printing carrier 30 are both folded into a U-shaped configuration around the cigarette block 19, inner wrapper 12 the starting from side wall 23 which forms the base of the U. Additional folding steps at the opposite side wall 22 are performed in a known manner as the folding turret 41 advances to receiving the next partially formed pack.

This method of the invention thus permits the printing carrier to be assembled with existing manufacturing equipment and without modification of the equipment. Furthermore, no new steps are added to the method or process of receiving the partially-formed pack or any of the blanks comprising the several wrappers. The only modification is the placement of the printed carrier proximate a blank prior to the folding of the blank about the pack, as in the folding turret. In fact, the printed carrier can be placed on either side of the carrier, i.e., either facing toward, or away from the partially formed pack.

The embodiments of the cigarette pack described refer to soft cup packs, the soft cup 20 being made of a blank of paper. However, the invention can also be used advantageously in connection with other types of cigarette packs, specifically in connection with hinge-lid packs, where the printing carrier 20, 30, 31 can be preferably arranged between the hinge-lid pack made of thin cardboard and the outer wrapper 25 made of plastic film.

Printing carriers of the type and orientation illustrated by elements 29, 30,31 can be used for health warning information, or for advertising, as premium coupons, contest forms or the like.

I claim:

1. In a cuboidal cigarette pack (10) having a relatively large front wall (21) and corresponding rear wall (13), narrow side walls (22, 23), a bottom wall (15) and an opening end wall (16), the bottom wall (15) and end wall (16) being arranged transverse to the longitudinal direction of the cigarettes and the cigarettes (10) being removable from the pack in the region of the opening end wall (16) said pack consisting of an inner wrapper (12), a central wrapper (20) and an outer wrapper (25), with at least the central wrapper (20), or the outer wrapper (25), or both, being arranged so that their respective ends overlap (40, 26) along a first side wall (22), the improvement which comprises:

(a) a separate removable printing carrier (20, 30, 31) positioned in the pack adjacent the central wrapper, (b) said separate printing carrier extending across one side wall (23) and at least a portion of the front wall (21), or the rear wall (13), or both the front and rear walls of the pack, (c) where the width of the portion of the separate printing carrier that extends across the front wall, rear wall, or both, is substantially smaller than the width of either the front or rear walls, (d) wherein said separate printing carrier (29, 30, 31) is formed from a separate, independent blank that is not connected to the wrappers forming the pack, (e) and wherein said separate printing carrier (20, 30, 31) is positioned at the side wall (23) opposite the first side wall (22).

2. The cigarette pack of claim 1, where the separate printing carrier (29, 30, 31) is positioned between the outer wrapper (25) and the central wrapper (20).

3. The cigarette pack of claim 1, where the separate printing carrier is positioned between the inner wrapping (12) and the central wrapping (20).

4. The pack of claim 1, wherein the separate printing carrier (29, 30, 31) extends over the entire width of one side wall (22, 23), and over a portion of the front wall (21) or rear wall (13).

5. The pack of claim 1, wherein the separate printing carrier (30, 31) is folded into a U-shaped configuration and extends over the entire width of one side wall (22, 23), and extends over portions of the front wall (21) and the rear wall (13).

6. The pack of claim 1, wherein one edge of the separate printing carrier (29, 30, 31) is proximate the end wall (16).

7. The pack of claim 1, wherein the outer wrapper (25) is provided with a circumferential tear-open strip (27) positioned below the end wall (16).

8. The pack of claim 1, wherein the separate printing carrier extends across only a portion of the rear wall or the front wall.

9. The pack of claim 8, wherein the separate printing carrier (29) has an L-shaped configuration with a first leg (32) in the region of the side wall (23) and a second leg (33) in the region of the front wall or the rear wall, where the width of the second leg (33) is approximately half the width of the front wall or rear wall.

10. The pack of claim 5, wherein the separate printing carrier (30, 31) has a U-shaped configuration with a central leg (34) in the region of the side wall (22, 23), and with two side legs (35, 36) overlying the front wall (21) and rear wall (13), where the width of the side legs is substantially less than the width of the front wall and the rear wall.

11. The pack of claim 1, wherein the separate printing carrier (29, 30, 31) has a tongue-shaped gripping piece (37) extending from one edge which is folded into the plane of the end wall (16) when the pack is closed.

12. The pack of claim 6, wherein the gripping piece (37) extends from the separate printing carrier proximate the side wall (23) and is folded into the plane of the end wall (16).

13. The pack of claim 12, wherein the edge of the separate printer carrier opposite the tongue-shaped gripping piece has a corresponding parallel contour.

14. The pack of claim 13, wherein the separate printing carrier is severed from a continuous web.

15. The pack of claim 1, which is a soft pack formed with a paper central wrapper and the separate printing carrier is positioned between the central and the inner wrappers.

16. The pack of claim 1 wherein the central wrapper and the separate printing carrier is positioned between the central and outer wrappers.

17. The pack of claim 1 in the form of a hinge-lid pack where the central wrapper is a box formed of thin cardboard and the separate printing carrier is positioned between the centrol and the inner wrappers (12).

18. The pack of claim 1, which is a hinge lid pack where the central wrapper is a box formed of thin cardboard and the separate printing carrier is positioned between the central and the outer wrapper.

* * * * *